US006119742A

United States Patent [19]

Maeng

[11] Patent Number: 6,119,742

[45] Date of Patent: Sep. 19, 2000

[54] PROTECTIVE COVER FOR GOLF CLUB

[76] Inventor: Seop Maeng, 22-102 Hanyang Apartment, Songpa-Dong, Songpa-Ku, Seoul, Rep. of Korea

[21] Appl. No.: 09/088,520

[22] Filed: Jun. 2, 1998

[30] Foreign Application Priority Data

Jun. 3, 1997 [KR] Rep. of Korea ..... 97-22847

[51] Int. Cl.[7] ..... A63B 57/00

[52] U.S. Cl. ..... 150/160; 206/315.2; 206/315.4

[58] Field of Search ..... 150/159, 160; 206/315.2, 315.4

[56] References Cited

U.S. PATENT DOCUMENTS

| | | | |
|---|---|---|---|
| 2,128,546 | 8/1938 | Venmore | 150/160 |
| 2,508,525 | 5/1950 | Le Fevre | 150/160 |
| 2,705,039 | 3/1955 | Halter | 150/160 |
| 3,117,609 | 1/1964 | Pio | 150/160 |
| 3,613,760 | 10/1971 | Koehnle | 150/160 |
| 3,664,399 | 5/1972 | Neff | 150/160 |
| 3,861,434 | 1/1975 | Harding | 150/160 |
| 3,892,267 | 7/1975 | Bibeau | 150/160 |
| 4,195,677 | 4/1980 | Hagg et al. | 150/160 |
| 4,378,832 | 4/1983 | Thompson | 150/160 |
| 5,000,238 | 3/1991 | Zeller | 150/160 |
| 5,050,655 | 9/1991 | Borenstein | 150/160 |

FOREIGN PATENT DOCUMENTS

| | | | |
|---|---|---|---|
| 383013 | 11/1932 | United Kingdom | 150/160 |

*Primary Examiner*—Sue A. Weaver
*Attorney, Agent, or Firm*—Chapman & Cutler

[57] ABSTRACT

A protective cover for a golf club includes a pair of head covers hingably coupled to each other to swing horizontally between open and closed states, thereby achieving very accurate and rapid opening and closing operations while ensuring protection for the head and shaft of a golf club, received therein, against any external impact. In one form of the invention, a plurality of hinge members are formed on rear ends of the side walls of the head cover members. A hinge pin is vertically inserted into pin holes of mating ones of the hinge members at the hinge when the pin holes are vertically aligned, thereby hingably coupling the mating hinge members together. A pair of magnets are provided at front ends of the side walls of the head cover members defining an opening of the protective cover, respectively.

10 Claims, 6 Drawing Sheets

PROTECTIVE COVER FOR GOLF CLUB

BACKGROUND OF THE INVENTION

1. Field of the Invention

The present invention relates to a protective cover for a golf club.

2. Description of the Prior Art

Referring to FIG. 1, a golf bag 21, is partitioned to separately receive a plurality of golf clubs therein. The golf bag 21 also has a slope at the bottom thereof so that the user can easily and conveniently select and extract one of golf clubs 1 from the golf bag 21 for use.

Golf clubs 1 are received in the golf bag 21 while being arranged together in parallel in such a manner that those having shorter lengths are received in the front portion of the golf bag 21 whereas those having longer lengths are received in the rear portion of the golf bag 21. Accordingly, the golf clubs 1 can be easily selected for use. Meanwhile, when the user carries the golf bag 21, golf clubs 1 received in the golf bag 21 may shift or move, so that they come into contact with one another.

Where golf clubs 1 are received in the golf bag 21 in a manner shown in FIG. 1, even among portions partitioned by internal walls 22, as shown, the head 2 of a shorter one of adjacent golf clubs 1 comes into contact with the shaft 3 of the longer golf club, thereby causing the shaft 3 of the longer golf club to be scratched. As a result, the paint layer on the surface of the shaft 3 is scratched and may peel off. This results in a degradation in the appearance of the golf club.

In order to solve such a problem, a head cover as illustrated in FIG. 2 has been proposed. As shown in FIG. 2, a head cover portion 4 is adapted to enclose the head 2 of a golf club 1, and a shaft cover portion 5 is adapted to enclose the lower portion of the shaft 3 of the golf club 1 adjacent to the head 2.

This head cover is put onto the golf club 1 before the golf club 1 is received in the golf bag 21. That is, the head cover is put onto the golf club 1 by inserting the head 2 of the golf club 1 into an opening defined at the lower end of the shaft cover portion 5 while the golf club 1 is held in an inverted (club end down) position, until the head 2 is enclosed by the head cover portion 4 while the shaft 3 is enclosed by the shaft cover portion 5.

Accordingly, it is possible to prevent the shaft 3 of the golf club 1 from being damaged due to its movement occurring while carrying the golf bag, because the head cover encloses the head 2 and shaft 3.

However, the opening of the shaft cover portion 5 of such a head cover has a small dimension, taking into consideration the thin construction of the shaft 3 of the golf club 1. Due to such a small dimension of the opening, considerable effort is required to put the head cover onto the golf club 1 and to taking the head cover off the club head. In other words, it is impossible to rapidly put the head cover onto the golf club 1 because the user should insert the head 2 of the golf club 1 into the opening of the head cover while widening the opening of portion 5 by hand. For taking off the head cover, a strong force is again required to extract the head of the golf club through the narrow opening of the head cover.

Furthermore, when the golf club 1, with the head cover is put, into the golf bag 21, the shaft cover portion 5 of the head cover may come into contact, at the lower end thereof, with the heads of other golf clubs already received in the golf bag 21, the head covers of the latter golf clubs or the upper ends of partitions 22 provided in the golf bag 21. As a result, the shaft cover portion 5 of the head cover may shift upwardly at its lower end.

When the head cover portion 5 of the head cover shifts upwardly at its lower end as mentioned above, the shaft 3 of the golf club 1 is exposed, so that it may come into direct contact with other golf clubs. For this reason, this form still permits degradation in the appearance of the golf club shaft.

FIG. 3 illustrates another conventional head cover. This head cover has a cover body 11 adapted to enclose both the head 2 and the lower portion of the shaft 3 of a golf club 1. The cover body 11 is longitudinally slitted to allow an easy insertion of the head 2 and shaft 3 of the golf club 1 into the head cover. The head cover also has a slide fastener 12 attached to the slitted portion of the cover body 11. In the case of this head cover, the slide fastener 12 attached to the cover body 11 is open upon putting the head cover on the golf club 1. Thereafter, the head 2 of the golf club 1 is inserted into the head cover through the wide opening of the head cover. After the insertion, the slide fastener 12 is closed. Thus, the head cover is put onto the golf club 1, so that it protects the head 2 and the lower portion of the shaft 3.

However, this head cover still has an inconvenience in that the slide fastener 12 should be manipulated to be opened and closed every time the head cover is put on the golf club or taken off from the golf club.

Typically, the head cover is made of a thick fabric in order to provide a buffering function. For this reason, the head cover is bulky, so that it unnecessarily occupies a large space. This results in a bulky structure of the golf bag 21 itself.

On the other hand, U.S. Pat. No. 5,547,193 discloses a "golf club cover". Similarly to the head cover of FIG. 3, the golf club cover disclosed in the patent has a head cover portion adapted to enclose the head of a golf club, and a shaft cover portion extending downwardly from the head cover portion and serving to enclose the lower portion of the shaft of the golf club.

This golf club cover has a different configuration from the head cover of FIG. 3, only in that it has a longitudinal slot formed in the shaft cover portion, in order to conveniently insert the head and shaft of the golf club into the protective cover. However, this golf club cover still has an inconvenience in that to insert the head and shaft of the golf club into the protective cover the slot must be widened.

SUMMARY OF THE INVENTION

An object of the invention is to solve the above mentioned problems in the prior. A protective cover for a golf club includes a pair of head covers hingably coupled to each other in such a manner that they can hinge horizontally (when the club shaft is vertical) between an open state and a closed state. Very accurate and rapid opening and closing is provided while protecting the head and shaft of a golf club received therein against external impacts.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DESCRIPTION OF THE PREFERRED EMBODIMENTS," one will understand how the features of this invention provide its benefits, which include, but are not limited to, durability, ease of use, and protection for the head and shaft of a golf club.

A first feature of the protective cover of this invention is that it includes a pair of head cover members adapted to enclose a head of a golf club. Typically, each head cover member has a top wall, bottom wall and a side wall connecting the top wall and bottom wall. The side wall of each head cover member has an open side, and these open sides face each other. There is a groove or opening in each of the bottom walls along an internal edge of the bottom wall disposed along the open side. These openings are aligned so that with the head cover members in the closed position the openings are adjacent each other to provide a passageway adapted to receive a shaft of a golf club.

A second feature is a coupling member adapted to hingably couple the head cover members to each other in a manner that the head cover members hinge horizontally between an open state or position and a closed state or position. (As used herein, "horizontally" refers to the head cover members opening and closing when uncovering or covering a head of a golf club where the golf club shaft is oriented vertically.) Thus, in the open state or position, the head cover members are adapted to receive or remove the head of a golf club and in the closed state or position the head cover members form an enclosure adapted to cover or enclose a head of a golf club. The coupling means may comprise one or more hinges disposed along the side wall or along internal edges of the top and bottom walls. When a plurality of hinges are employed, they are aligned with each other. These hinges may be in the rear of the side wall or substantially centrally located respectively in the top and bottom walls. In one embodiment, a hinge element is used in the form of a common side wall for each cover member which has a reduced thickness compared to the portions of the side wall forming the pair of head cover members.

The third feature is a locking member adapted to keep the head cover members in the closed state or position. This locking member normally urges the head cover members into the closed position but allows the head cover members to be manually manipulated and moved into the open position. The locking member may be magnetic members in the side walls or an elastic member connected between the pair of head cover members.

The fourth feature is that the side walls of head cover members provide an open space over which extends a fabric member that folds upon itself when the head cover members are in the open position and stretches across this space when the head cover members are in the closed position. Preferably, the longitudinal edges of the side wall of each head cover member form knobs that facilitate easy opening of the head cover members. These knobs are grasped between the thumb and index finger of the user and pushed towards each other to move the head covers members into the open position. With the knobs so pushed towards each other, the fabric is folded upon itself. Upon release of the user's grasp. the locking member automatically returns the head cover members to the closed position.

A fifth feature is that a protective bar is attached to the underside of each of the bottom walls. Each protective bar extends downwardly from one of the bottom walls at the opening in this bottom wall. These protective bars surround the passageway upon moving the head cover members to the closed position.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Referring to FIGS. 4 to 13, protective covers for golf clubs having configurations according to various embodiments of the present invention are illustrated.

Figure 1:
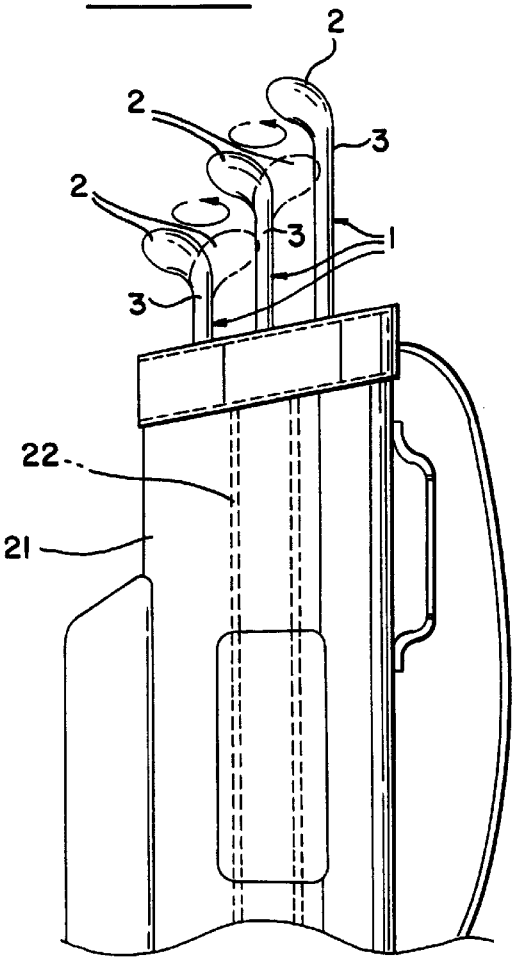
FIG. 1 PRIOR ART
FIG. 1 is a side view illustrating how golf clubs are received in a golf bag in a conventional manner.
Figure 2:
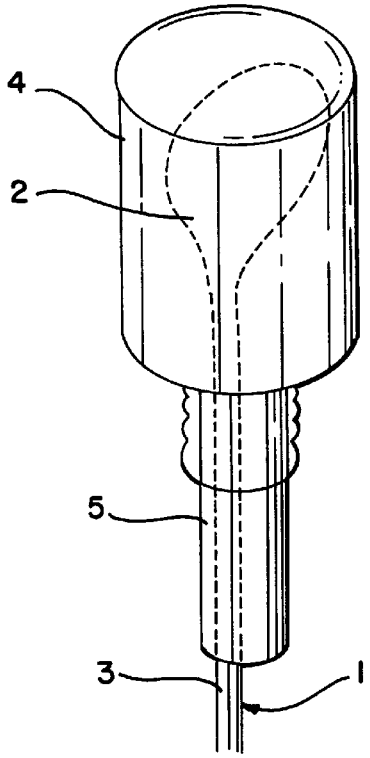
FIG. 2 PRIOR ART
FIG. 2 is a perspective view illustrating a conventional protective cover for a golf club.
Figure 3:
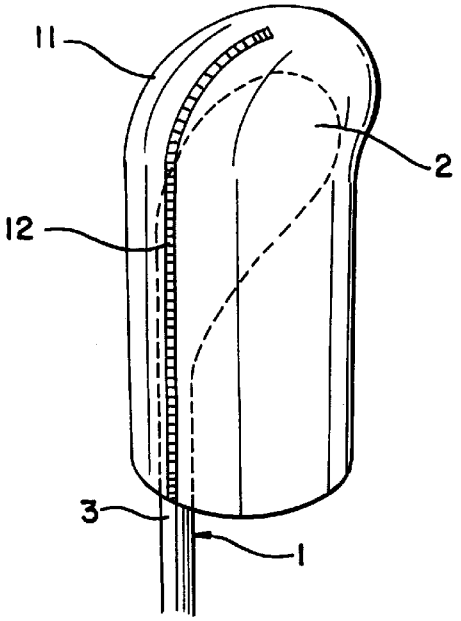
FIG. 3 PRIOR ART
FIG. 3 is a perspective view illustrating another conventional protective cover for a golf club.
Figure 4:
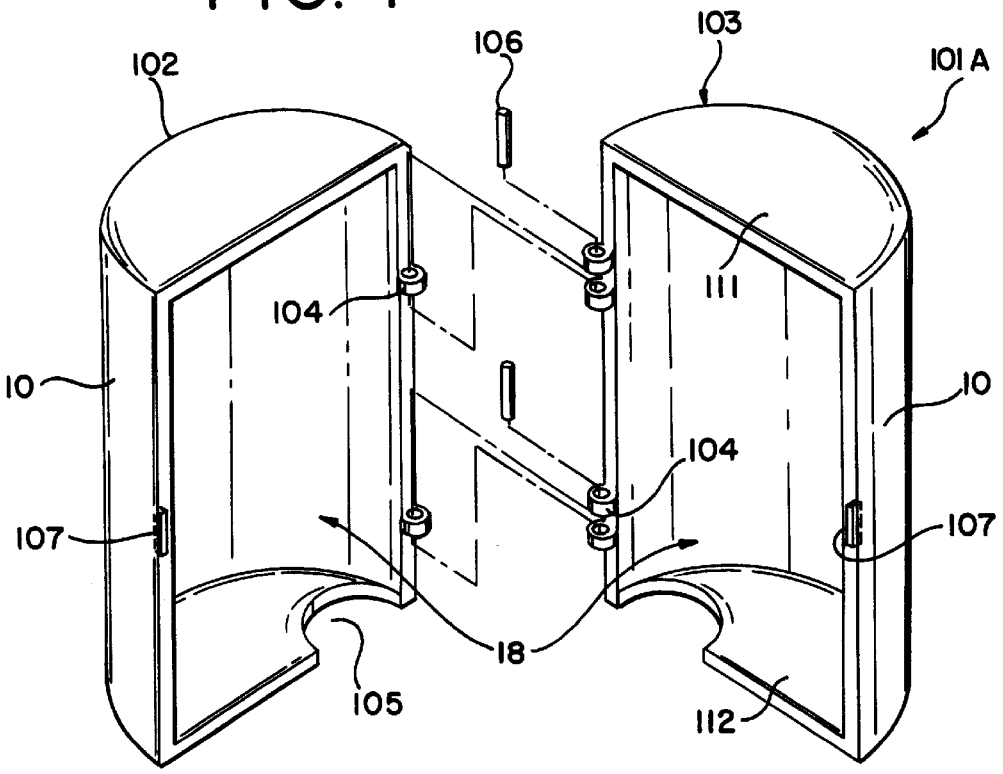
FIG. 4 is a perspective view illustrating a protective cover for a golf club according to an embodiment of the present invention.
Figure 5:
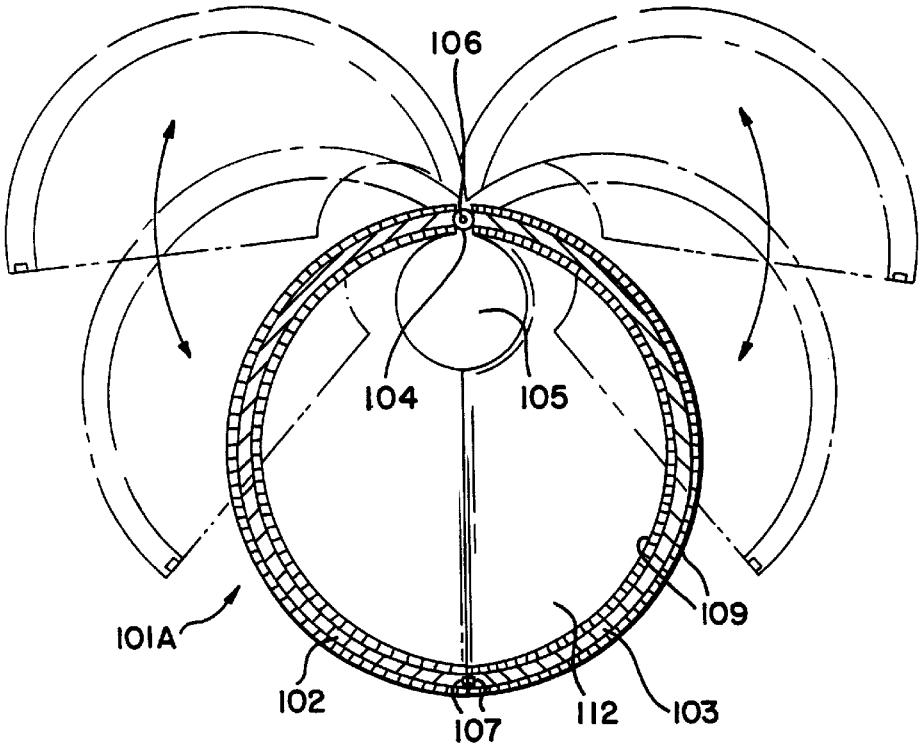
FIG. 5 is a cross-sectional view illustrating operation of the protective cover shown in FIG. 4.
Figure 6:
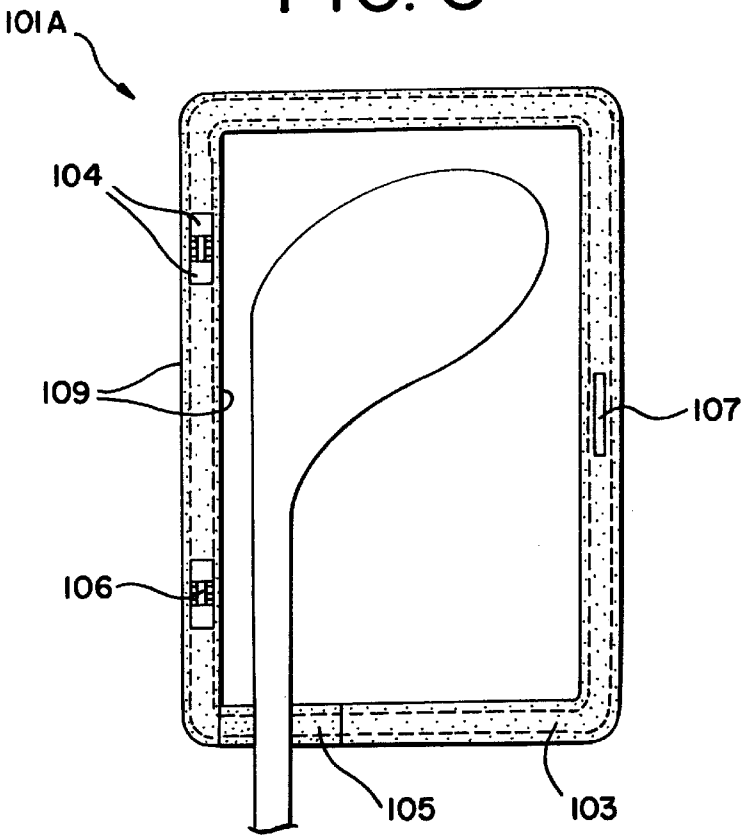
FIG. 6 is a sectional view illustrating use of the protective cover shown in FIG. 4.

FIGS. 4 to 6 illustrate a protective cover for a golf club according to one embodiment of the present invention.

As shown in FIG. 4, the protective cover, which is denoted by the reference numeral 101A, includes a pair of head cover members 102 and 103 adapted to protect the head of a golf club. Each of the head cover members 102 and 103 has a semi-circular top wall 111, a semi-circular bottom wall 112, and a side wall 10 connecting the top and bottom walls 111 and 112. The side wall 10 is semi-circular so that open interior sides 18 of each head cover member 102 and 103 face each other.

The protective cover 101A also includes a head cover member coupling means adapted to hingably couple the head cover members 102 and 103 to each other in such a manner that the head cover members 102 and 103 swing horizontally (with the club shaft oriented vertically) between an open state and a closed state in order to receive the head of a golf club. The protective cover is removable from the head of the golf club for use of the golf club. In order to keep the head cover members 102 and 103 closed, the protective cover further includes a locking means.

The head cover member coupling means comprises a plurality of hinge members 104 protruded from the rear ends of the side walls of the head cover members 102 and 103. Although the head cover member coupling means has two hinges in the illustrated case, it may have a single hinge or three hinges. Each of the hinge members 104 has a vertical pin hole. At each hinge, a hinge pin 106 is vertically inserted into the pin holes of mating ones of the hinge members 104 under the condition in which the pin holes are vertically aligned together, so that the mating hinge members 104 are hingably coupled together. Accordingly, the head cover members 102 and 103 can swing horizontally about the vertical hinge pins 106.

The locking means comprises a pair of magnets 107 respectively provided at the front ends of the side walls of the head cover members 102 and 103, at the opening of the protective cover and opposite to the side wall portions of those head cover members 102 and with the hinge members 104. The magnets 107 serve to keep the head cover members 102 and 103 in their closed state by virtue of their magnetic force, as indicated by the solid lines of FIG. 5. To open the protective cover 101A, the user applies a slight force to the head cover members 102 and 103 in a direction separating the magnets 107 by hand, thereby causing the head cover members 102 and 103 to swing from their closed state toward their open state, as indicated by the phantom line of FIG. 5.

The protective cover 101A further includes a club shaft hole 105 which is defined by semicircular walls formed in the bottom walls of the head cover members 102 and 103 adjacent to the side wall portions where the hinge members 104 are arranged. When a golf club is received in the protective cover 101, the shaft of the golf club extends through the shaft hole 105. The head cover members 102 and 103 of the protective cover 101A are molded using a synthetic resin material.

Fabrics 109 as in FIG. 6 are attached to the inner and outer surfaces of each head cover member. The fabrics 109 serve to cushion the head cover members 102 and 103 against external impacts. The fabrics 109 also prevent the head and shaft of the golf club, received in the protective cover 101A, from being scratched by the inner surfaces of the head cover members 102 and 103.

Since the shaft hole 105 is arranged adjacent to the side wall portions of the head cover members 102 and 103 where the hinge members 104 are formed, the head of the golf club received in the protective cover 101A occupies a minimum space.

When it is desired to put the protective cover 101A on a golf club, the head cover members 102 and 103 are first horizontally opened (with the club shaft and hinge pin 106 vertical). Thereafter, the head of the golf club is inserted into the open interior of the protective cover 101. The head cover members 102 and 103 are moved toward their closed state. These head cover members 102 and 103 are then kept in their closed state by the magnetic force of the magnets 107.

In this state, the head of the golf club is received in the protective cover 101A while the shaft of the golf club extends downwardly through the shaft hole 105 of the protective cover 101A. Accordingly, the head of the golf club and the lower portion of the shaft adjacent to the head are prevented from coming into contact with other golf clubs received in a golf bag. Thus, those portions of the golf club are protected from a degradation in the appearance thereof.

Figure 7:
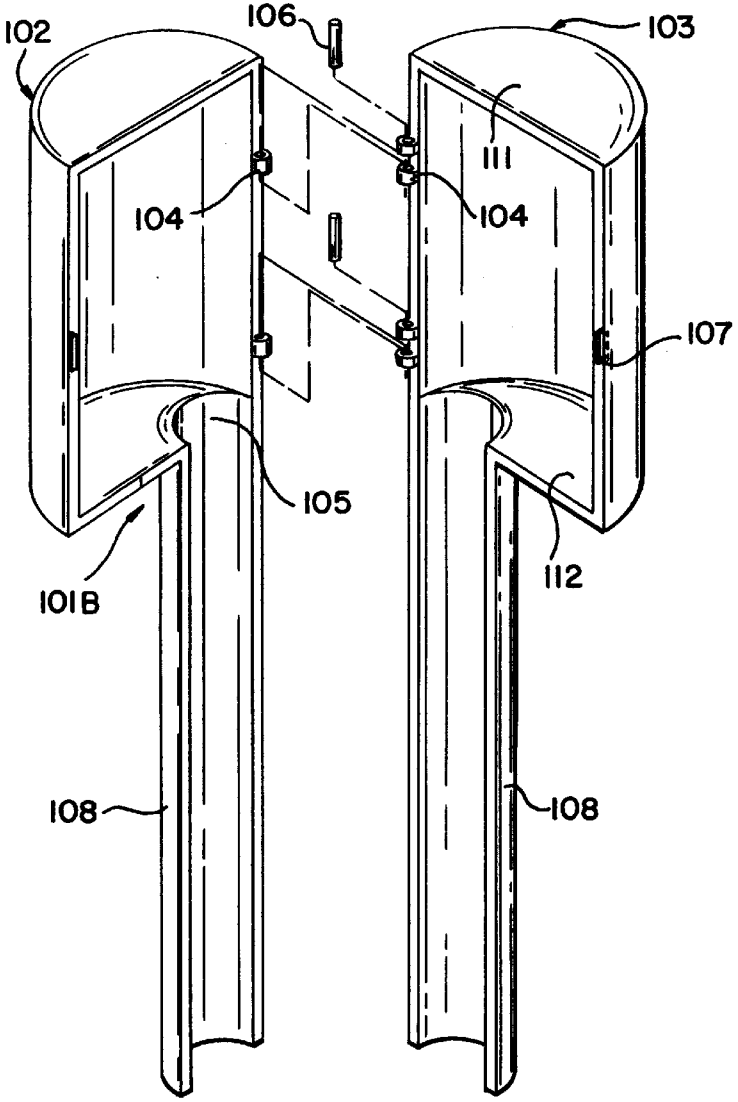
FIG. 7 is an exploded perspective view illustrating another embodiment of the present invention.
Figure 8:
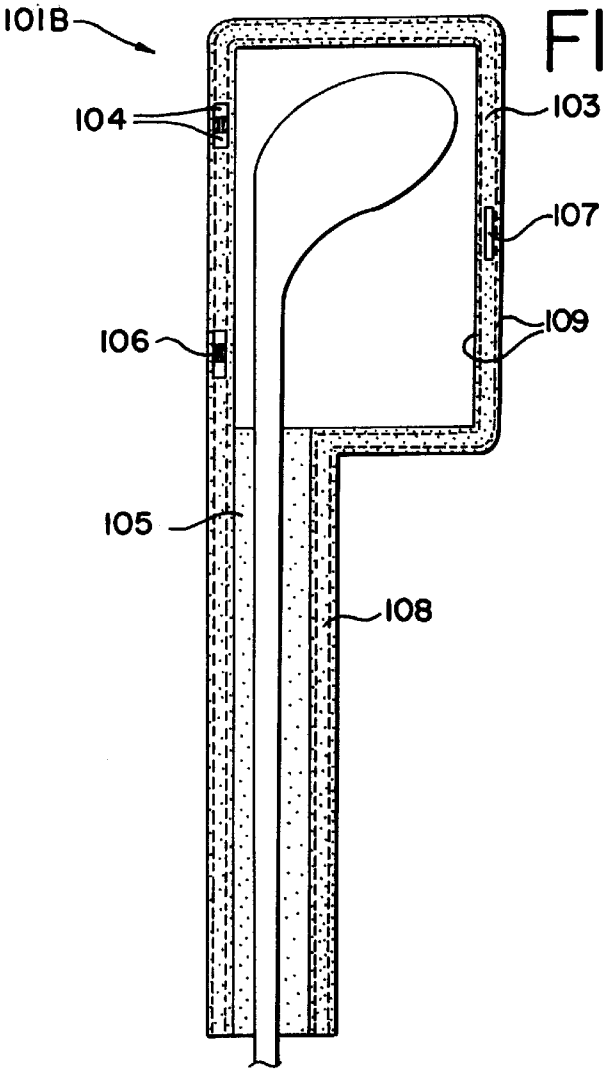
FIG. 8 is a sectional view illustrating use of the protective cover shown in FIG. 7.

Referring to FIGS. 7 and 8, a protective cover modified from the structure of FIGS. 4 to 6 is illustrated at 102B. In this case, a pair of U-shaped shaft protectors 108 extend downwardly from respective bottom walls of the head cover members 102 and 103 around the shaft hole 105, in order to provide a shaft protective space. The shaft protective space covers an increased portion of the shaft of the golf club. Thus, the protective cover according to this embodiment can more surely protect the shaft of the golf club.

Figure 10:
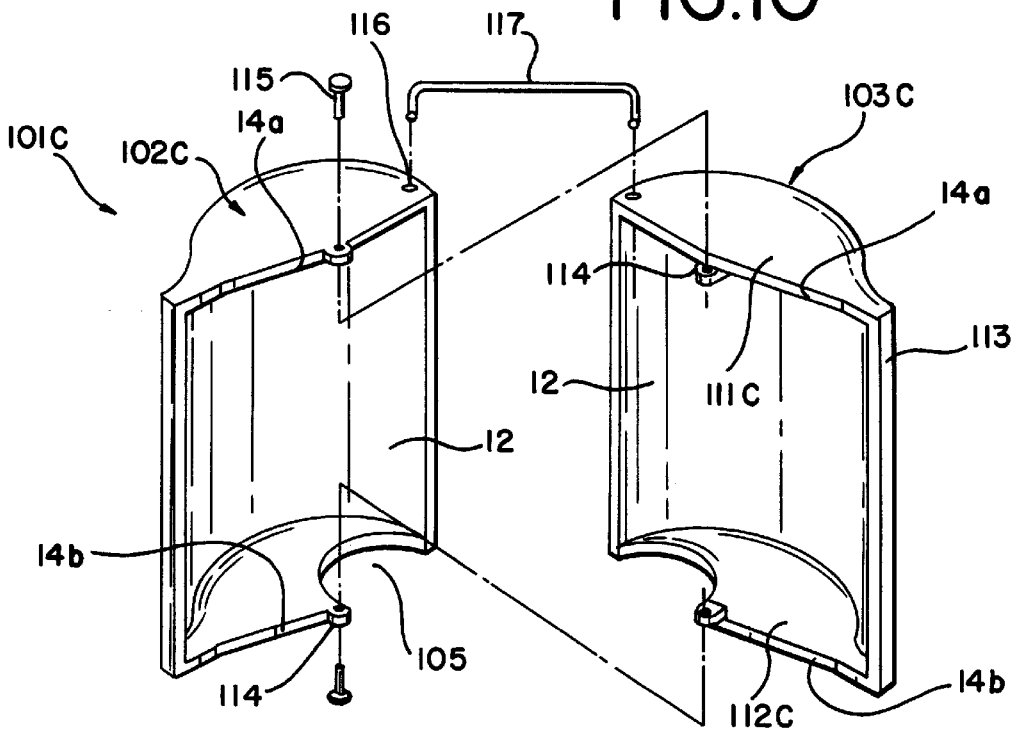
FIG. 10 is an exploded perspective view illustrating a protective cover according to another embodiment of the present invention.

FIG. 10 illustrates another protective cover 101C modified from the structure of FIGS. 4 to 6. In this case, each of the head cover members 102C and 103C has an arc-shaped top wall 111C, an arc-shaped bottom wall 112C, and a side wall 12 connecting the top and bottom walls 111C and 112C. The head cover member coupling means comprises a pair of hinge members 114 respectively protruded from the inner edges of the top and bottom walls 111C and 112C in each head cover member. A hinge pin 115 is vertically inserted into the pin holes of mating ones of the hinge members 114 with the pin holes vertically aligned, so that the mating hinge members 114 are hingably coupled together. Accordingly, the head cover members 102C and 103C can swing horizontally about the vertical hinge pins 115.

In this embodiment, the locking means, which serves to keep the head cover members 102C and 103C in their closed state, comprises an elastic member 117 fitted at both ends thereof in holes 116 respectively formed through the top walls 111 of the head cover members 102C and 103C adjacent to the rear end of the protective cover. The elastic member 117 serves to always urge the head cover members 102C and 103C in such a manner that the rear portions of the head cover members 102 and 103 move hingably about the hinge pins 115 toward each other. Normally, the head cover members 102C and 103C are maintained in the state shown in FIG. 11 by virtue of the elastic member 117.

A pair of grips 113 extend forwardly from the front ends of the side walls of the head cover members 102 and 103, respectively. Normally, the grips 113 are spaced away from each other by the function of the elastic member 117. When the user applies a force to the grips 113 by hand, thereby moving those grips 113 toward each other against the resilience of the elastic member 117, the head cover members 102C and 103C move hingably about the hinge pins 115 in such a manner that the rear portions of the head cover members 102C and 103C are spaced away from each other. That is, the protective cover 101C is open, as shown in FIG. 11, in order to allow insertion of a golf club thereinto.

Figure 11:
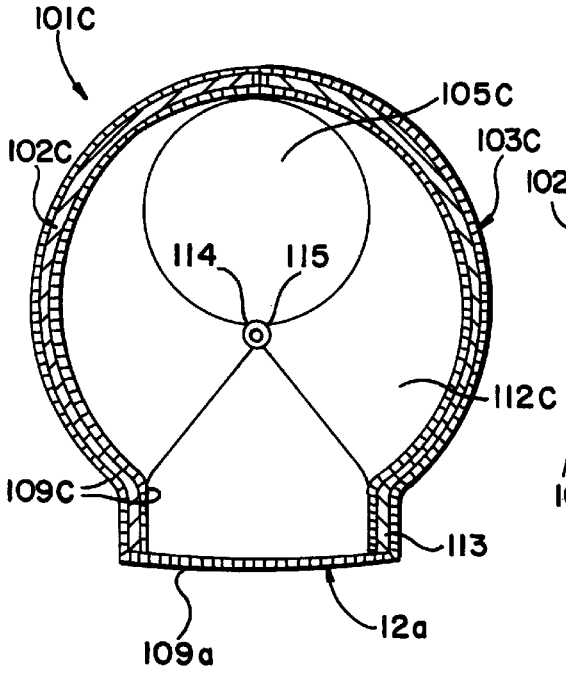
FIGS. 11 and 12 are cross-sectional views respectively illustrating closed and open states of the protective cover shown in FIG. 10.

When the user releases the force applied to the grips 113 after placing the head and shaft of the golf club into the open protective cover, the head cover members 102C and 103C swing to their original closed state shown in FIG. 11 by virtue of the resilience of the elastic member 117.

Thus, the head and shaft of the golf club can be easily protected.

Figure 12:
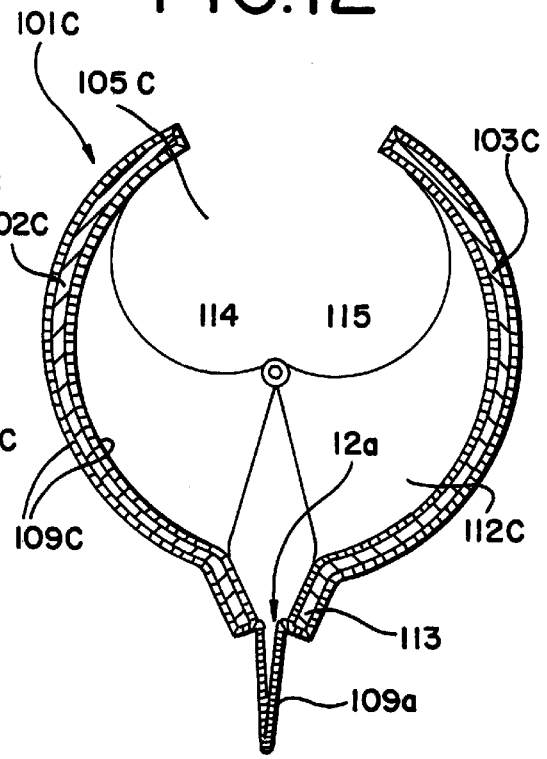

As illustrated in FIGS. 10, 11 and 12, each of the arc-shaped top and bottom walls of the head cover members 102C and 103C is less than 180 degrees so that, as best shown in FIGS. 11 and 12, there is a space 12*a* between the grips 113. A portion 109*a* of the fabric 109C on the external surface of the head cover members 102C and 103C extends across this space 12*a*. The portion 109*a* of the fabric 109C folds upon itself when the protective cover is opened as illustrated in FIG. 12, and then stretches to extend across the space 12*a* in the form of a smooth generally flat unfolded piece of fabric.

Figure 13:
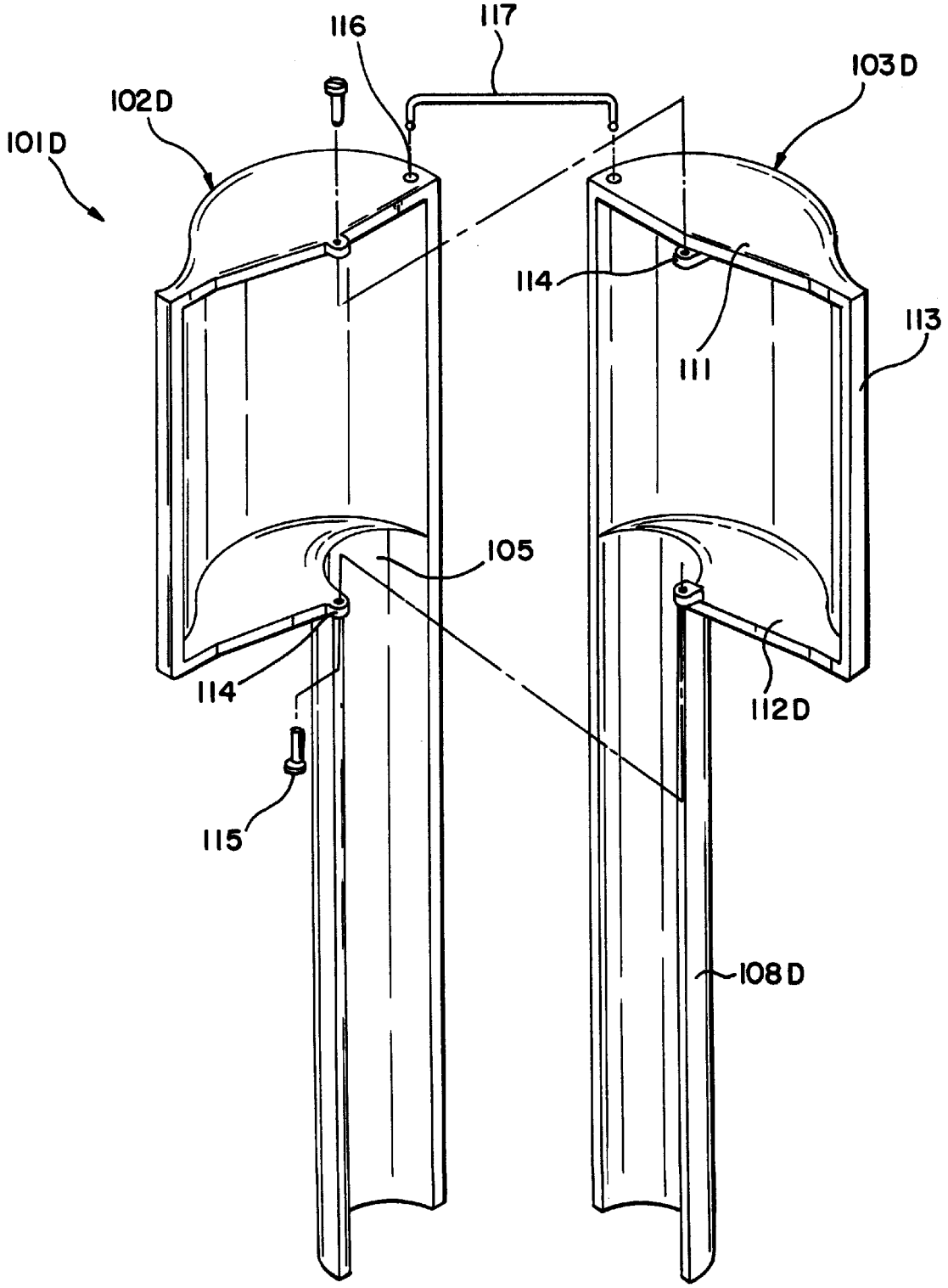
FIG. 13 is an exploded perspective view illustrating a protective cover according to another embodiment of the present invention.

It will also be noted that in the embodiment shown in FIGS. 10, 11 and 12 and in FIG. 13, the hinge members 114 and their pins 115 are positioned along the internal edges 14*a* and 14*b* respectively of the top and bottom walls 111C and 112C of the head cover members 102C and 103C, preferably at or near a central position along the longitudinal axis of the protective cover. In contrast, in the embodiment shown in FIGS. 4 through 8, the hinge members 104 and their pins 106 are disposed at or near the perimeter of the protective cover 101A at its rear.

FIG. 13 illustrates a protective cover 101D modified from the structure of FIG. 10. In this case, a pair of shaft protectors 108D extend downwardly from respective bottom walls of the protective cover around the shaft hole 105. The shaft protectors 108D cover an increased portion of the shaft of the golf club. Thus, the protective cover 101D according to this embodiment can more surely protect the shaft of the golf club.

Figure 9:
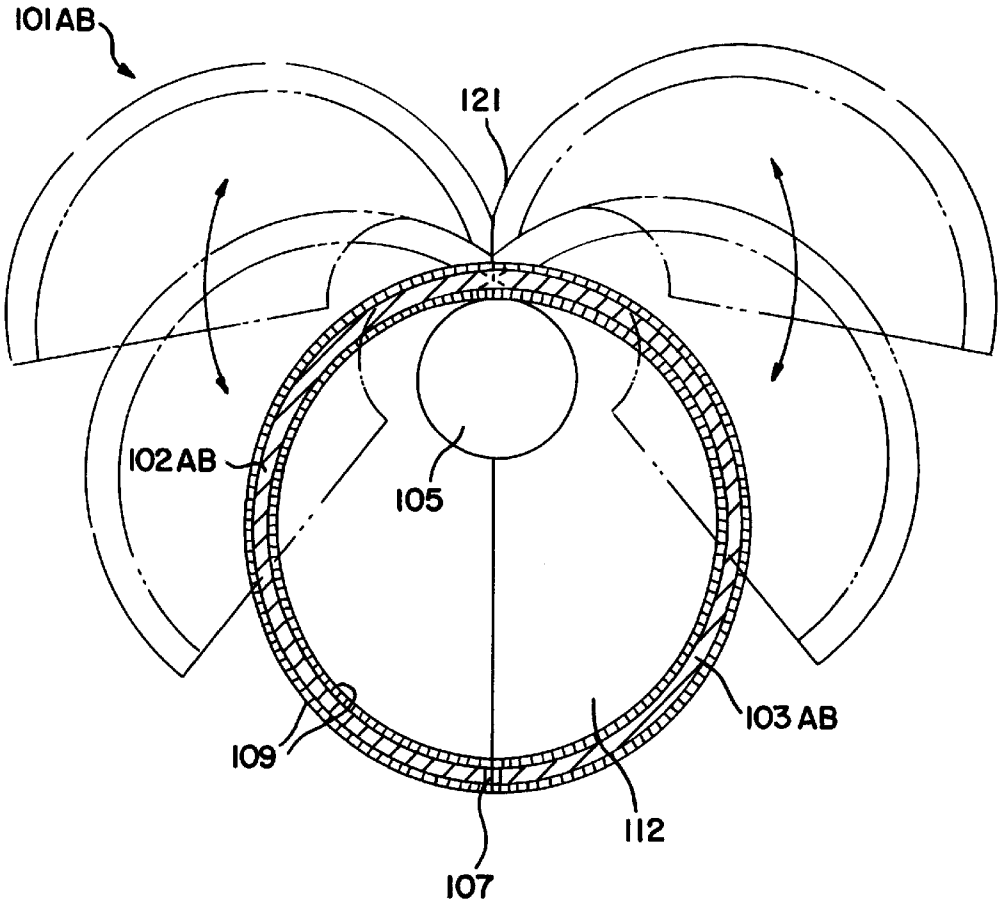
FIG. 9 is a cross-sectional view of a modified form of a protective cover similar to that shown in FIG. 8.

The two cover members 102 and 103 of FIGS. 4 to 6 or 7 and 8 may alternatively be integrally formed as shown in FIG. 9. The head cover member coupling means, which serves to horizontally hinge the head cover members 102 and 103 between an open state and a closed state, may comprise a connecting portion 121 formed between the rear ends of the side walls of the head cover members 102AB and 103AB having a reduced thickness as compared to that of the head cover members 102 and 103. Since the connecting portion 121 has a thickness smaller than that of the head cover members 102 and 103, it serves as a hinge for the head cover members 102 and 103.

As apparent from the above description, the present invention provides a protective cover for a golf club which includes a pair of head covers hingably coupled to each other in such a manner that they can hinge horizontally between an open state and a closed state, thereby achieving very accurate and rapid opening and closing while ensuring protection for the head and shaft of a golf club, received therein, against any external impact.

Since the protective cover can be rapidly opened and closed, it provides improved convenience for inserting and taking out the head and shaft of a golf club. That is, the protective cover of the present invention completely eliminates the problems involved in the conventional protective covers.

In addition, since the protective cover of the present invention can be made of a synthetic resin material, its structure is light. Furthermore, easy manufacture is achieved. Accordingly, mass production is possible.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A protective cover for a golf club comprising:

a pair of head cover members adapted to enclose a head of the golf club, thereby protecting the head of the golf club, each of the head cover members having a top wall, a bottom wall, and a side wall connecting the top and bottom walls;

a head cover member coupling means adapted to hingeably couple the head cover members to each other in such a manner that the head cover members hinge horizontally between an open state and a closed state, when a shaft of the club is oriented vertically, in order to receive the head of the golf club therein and to take the protective cover off from the head of the golf club for using the golf club; and a locking member adapted to keep the head cover members in the closed state, and wherein the head cover member coupling means comprises:

a pair of hinge members respectively protruded from inner edges of the top and bottom walls in each of the head cover members; and a hinge pin vertically inserted into the pin holes of mating ones of the hinge members for the head cover members with the pin holes are vertically aligned together, thereby hingeably coupling the mating hinge members together.

2. The protective cover according to claim 1, wherein the locking member comprises an elastic member fitted at both ends thereof in holes respectively formed through the top walls of the head cover members adjacent to the rear ends of the side walls of the head cover members.

3. The protective cover according to claim 1, further comprising:

a pair of grips extending forwardly from front ends of the side walls of the head cover members, respectively, and adapted to facilitate easy opening of the protective cover.

4. A protective cover for a golf club, the cover comprising:

a pair of head cover members adapted to enclose a head of the golf club, thereby protecting the head of the golf club, each of the head cover members having a top wall, a bottom wall, and a side wall connecting the top and bottom walls;

a head cover member coupling means adapted to hingably couple the head cover members to each other in such a manner that the head cover members hinge horizontally between an open state and a closed state in order to receive the head of the golf club therein and to take the protective cover off from the head of the golf club for using the golf club;

a locking member adapted to keep the head cover members in the closed state;

a shaft hole formed in the bottom walls of the head cover members adjacent to rear ends of the side walls of the head cover members, the shaft hole serving to receive a shaft of the golf club; and a pair of shaft protectors extending downwardly from respective bottom walls of the head cover members around the shaft hole and adapted to protect the shaft of the golf club.

5. A protective cover for a golf club, the cover comprising:

a pair of head cover members adapted to enclose a head of the golf club, thereby protecting the head of the golf club, each of the head cover members having a top wall, a bottom wall, and a side wall connecting the top and bottom walls, the bottom wall having an opening therein;

a head cover member coupling means adapted to hingably couple the head cover members to each other in such a manner that the head cover members hinge horizontally between an open state and a closed state in order to receive the head of the golf club therein and to take the protective cover off from the head of the golf club for using the golf club, wherein the head cover member coupling means comprises a connecting portion formed between the rear ends of the side walls of the head cover members and adapted to connect the head cover members in such a manner that the head cover members are integral with each other, the connecting portion having a reduced thickness compared to that of the head cover members;

a locking member adapted to keep the head cover members in the closed state; and a pair of shaft protectors extending downwardly from respective bottom walls of the head cover members about the opening therein and adapted to protect the shaft of the golf club.

6. A protective cover for a golf club, comprising:

a pair of head cover members, each head cover member having a top wall, a bottom wall, and a side wall connecting the top wall and the bottom wall yet leaving one portion of a side of each head cover member open;

a hinge element which connects the head cover members together with the open sides facing each other to enable the head cover members to be manually moved between an open position adapted to receive therebetween a head of a golf club and a closed position which forms an enclosure for a head of a golf club;

an opening in each of the bottom walls along an internal edge of the bottom wall disposed along the open side, said openings in the bottom walls being aligned so that, with the head cover members in the closed position, said openings are adjacent each other to provide a passageway adapted to receive a shaft of a golf club; and a locking member which normally urges the head cover members into the closed position but allows the head cover members to be manually manipulated and move into the open position wherein the hinge element includes one hinge positioned along an internal edge of the top wall and another hinge element positioned along an internal edge of the bottom wall, said hinge elements being aligned with each other.

7. The protective cover of claim 6 where said hinges are substantially centrally located along said internal edges.

8. A protective cover for a golf club, comprising:

a pair of head cover members, each head cover member having a top wall, a bottom wall, and a side wall connecting the top wall and the bottom wall yet leaving one portion of a side of each head cover member open;

a hinge element which connects the head cover members together with the open sides facing each other to enable the head cover members to be manually moved between an open position adapted to receive therebetween a head of a golf club and a closed position which forms an enclosure for a head of a golf club;

an opening in each of the bottom walls along an internal edge of the bottom wall disposed along the open side, said openings in the bottom walls being aligned so that, with the head cover members in the closed position, said openings are adjacent each other to provide a passageway adapted to receive a shaft of a golf club; and a locking member which normally urges the head cover members into the closed position but allows the head cover members to be manually manipulated and move into the open position wherein the side walls of head cover members provide an open space over which extends a fabric member that folds upon itself when the head cover members are in the open position and stretches across said space when the head cover members are in the closed position.

9. A protective cover for a golf club, the cover comprising:

a pair of head cover members, each head cover member having a top wall, a bottom wall, and a side wall connecting the top wall and the bottom wall yet leaving one portion of a side of each head cover member open;

a hinge element which connects the head cover members together with the open sides facing each other to enable the head cover members to be manually moved between an open position adapted to receive therebetween a head of a golf club and a closed position which forms an enclosure for a head of a golf club;

an opening in each of the bottom walls along an internal edge of the bottom wall disposed along the open side, said openings in the bottom walls being aligned so that, with the head cover members in the closed position, said openings are adjacent each other to provide a passageway adapted to receive a shaft of a golf club;

a locking member which normally urges the head cover members into the closed position but allows the head cover members to be manually manipulated and move into the open position; and a pair of shaft protectors, each protector extending downwardly from the bottom walls at the openings in said bottom walls to surround the passageway upon moving the head cover members to the closed position.

10. A protective cover for a golf club, the cover comprising:

a pair of head cover members, each head cover member providing a partial enclosure for a head of a golf club and each member having an open side and a bottom wall having an internal edge disposed along the open side;

a hinge element which connects the head cover members together with the open sides facing each other to enable the head cover members to be manually moved between an open position adapted to receive therebetween a head of a golf club and a closed position to form an enclosure for a head of a golf club; and an opening formed in each of the bottom walls along said internal edge of the bottom wall, said openings in the bottom walls being aligned so that with the head cover members in the closed position said openings are adjacent each other to provide a passageway adapted to receive a shaft of a golf club, wherein each cover member has a top wall and a side wall connecting the top wall to the bottom wall and the hinge element includes a pair of members, one hinge member positioned along an internal edge of the top wall and another hinge member positioned along an internal edge of the bottom wall, and said hinge members being aligned with each other.

* * * * *